US011329424B1

(12) United States Patent
Lin et al.

(10) Patent No.: US 11,329,424 B1
(45) Date of Patent: May 10, 2022

(54) GATHERING MECHANISM FOR ADAPTER

(71) Applicant: Le-Lin Peng, New Taipei (TW)

(72) Inventors: Kai-Hsuan Lin, New Taipei (TW); Ming-Chin Huang, New Taipei (TW); Le-Lin Peng, New Taipei (TW)

(73) Assignee: Le-Lin Peng, New Taipei (TW)

( * ) Notice: Subject to any disclaimer, the term of this patent is extended or adjusted under 35 U.S.C. 154(b) by 78 days.

(21) Appl. No.: 17/087,981

(22) Filed: Nov. 3, 2020

(51) Int. Cl.
*H01R 13/60* (2006.01)
*H01R 31/06* (2006.01)

(52) U.S. Cl.
CPC ..... *H01R 13/60* (2013.01); *H01R 31/06* (2013.01)

(58) Field of Classification Search
CPC .... H01R 13/60; H01R 31/06; H01R 13/6397; F21S 8/065
See application file for complete search history.

(56) References Cited

U.S. PATENT DOCUMENTS 5,507,667 A * 4/1996 Hahn ..... H01R 13/60 439/501
5,702,021 A * 12/1997 Ito ..... H01R 13/506 220/780
6,270,370 B1 * 8/2001 Chien ..... H01R 13/60 439/371
7,510,426 B2 * 3/2009 Hwang ..... H01R 25/00 439/501
7,887,342 B1 * 2/2011 Yu ..... H01R 13/60 361/752
8,452,151 B2 * 5/2013 Schroeder ..... H01R 13/60 174/79
8,916,774 B2 * 12/2014 Richards ..... H02G 3/0487 439/639
9,784,338 B1 * 10/2017 Parrett ..... H01R 31/06
10,468,841 B2 * 11/2019 Rangi ..... H01R 25/162
10,517,188 B2 * 12/2019 Irons ..... H05K 7/1491
10,587,075 B1 * 3/2020 Lin ..... H01R 13/60
10,637,177 B2 * 4/2020 Murphy ..... H01R 9/2408
10,797,454 B1 * 10/2020 Lin ..... E05B 73/0005
10,817,453 B2 * 10/2020 Abdul-Razzak ..... G06F 1/1632
10,978,841 B2 * 4/2021 Liao ..... H01R 13/60
11,038,302 B2 * 6/2021 Williams ..... H02G 3/0437
2021/0040777 A1 * 2/2021 Restivo, II ..... E05B 73/0005

* cited by examiner

*Primary Examiner* — Thanh Tam T Le
(74) *Attorney, Agent, or Firm* — Chun-Ming Shih; HDLS IPR Services

(57) ABSTRACT

Provided is a gathering mechanism for adapter, including a cylindrical body having a plurality of accommodating units indentedly and spacedly mounted on a surface of the cylindrical body in an axial direction thereof; a plurality of adapters, each of which is provided with a flexible latching member on one end thereof, and the other end of the flexible latching member is a free end provided with a bulged joggle unit for being received in a corresponding accommodating unit; and an outer sleeve sleeving the cylindrical body and having at least one cut groove mounted in an axial direction of the outer sleeve for allowing the flexible latching member to transversely enter and exit the therethrough, and wherein a width of the cut groove is smaller than a width of the bulged joggle unit, thereby forming a limiting engagement. Thus, multiple adapters can be tidily gathered and protected.

9 Claims, 5 Drawing Sheets

GATHERING MECHANISM FOR ADAPTER

FIELD OF THE INVENTION

The invention is related to a cable adapter, and more particularly to a gathering mechanism for adapter.

BACKGROUND OF THE INVENTION

The conventional gathering mechanism for adapter is constructed by making a perforation on the adapter for allowing an annular rope to pass therethrough, and disposing and securing an engaging sleeve on the annular rope by locking the engaging sleeve in a fixed location of the annular rope. Thus, the adapters are cascaded and limited for use within the movable range of the annular rope. This can prevent the adapters from being stolen.

The purpose of the gathering mechanism is to protect newly-developed high-end connectors or adapters from being stolen or being deliberately taken away by customers in a crowded exhibition. If the newly-developed high-end connectors or adapters are stolen or deliberately taken away by customers as the test users forget to unplug the connectors or adapters, it would incur monetary damages to the vendors. What is worse, the vendor might not be able to normally exhibit the product to customers as the product is out of stock.

Another contemporary gathering mechanism for adapter is achieved by cascading multiple adapters together and attaching the adapters to a connection cable for sale. The user is allowed to replace the adapter with an adapter of a different specification that is to be inserted into the plug of the connection cable, such that the connection cable can be universally adapted for various kinds of connection ports on computer, communication, and consumer electronic products. In this way, the connection cable can be connected to popular peripheral devices, for example, liquid crystal displays, projectors, and stereos.

The current design of cable connector has evolved to be able to meet the requirements of the market and has gained popularity among customers. However, the contemporary gathering mechanism for adapter is disadvantageous in terms of coarse design style and insufficient applicability. It is therefore needed to address these disadvantages.

SUMMARY OF THE INVENTION

In view of the drawbacks encountered by the prior art, an object of the invention is to provide a gathering mechanism for adapter, which includes:

a cylindrical body having a plurality of accommodating units indentedly and spacedly mounted on a surface of the cylindrical body in an axial direction thereof;

a plurality of adapters, each of which is provided with a flexible latching member on one end thereof, and the other end of the latching member is a free end provided with a bulged joggle unit for being received in a corresponding accommodating unit; and an outer sleeve sleeving the cylindrical body and having at least one cut groove mounted in an axial direction of the outer sleeve for allowing the flexible latching member to transversely enter and exit therethrough, and wherein a width of the cut groove is smaller than a width of the bulged joggle unit, thereby forming a limiting engagement.

Preferably, both ends of the cylindrical body and the outer sleeve are respectively provided with a bulged sealing cap for securing and limiting the outer sleeve from moving transversely.

Preferably, the latching member is a steel rope having one end being a fixed end for connecting to the adapter. The fixed end includes a wiring terminal for passing through and being locked into a threaded bore of the adapter by a connecting element such as an ordinary screw or a self-tapping screw. The joggle unit may be implemented by a solid block or a wiring terminal.

Preferably, the cut groove is configured to be provided with unidirectional openings.

Preferably, the accommodating units may be disposed on the same side of the cylindrical body in a single line.

Preferably, the accommodating units may be disposed on different sides of the cylindrical body in double lines, and two cut grooves are individually mounted on an opposite side of the outer sleeve in an axial direction.

Compared to the prior art, the advantages of the invention are listed as follows: the invention offers the user a brand-new option to gather adapters. With the cylindrical body, the latching member, and the outer sleeve, the invention provides simple and tidy gathering and protection function for multiple adapters. By using the invention, the movable range of the adapters is limited by the length of the latching member to protect the adapters from being lost or being loosened and taken away by others. Thus, the invention can serve the purpose of preventing adapters from being stolen.

Besides, the inventive gathering mechanism can be rapidly and easily assembled to cascade multiple adapters to a connection cable for sale. Also, the user is allowed to purchase the inventive gathering mechanism optionally and install the gathering mechanism. According to the invention, the adapter can be replaced with an adapter of different specification that is to be inserted into the plug of the connection cable, such that the connection cable can be universally adapted for various kinds of connection ports on computer, communication, and consumer electronic products. Thus, the invention is applicable to contemporary peripheral devices, for example, liquid crystal displays, projectors, and stereos.

DETAILED DESCRIPTION OF PREFERRED EMBODIMENTS

Figure 1:
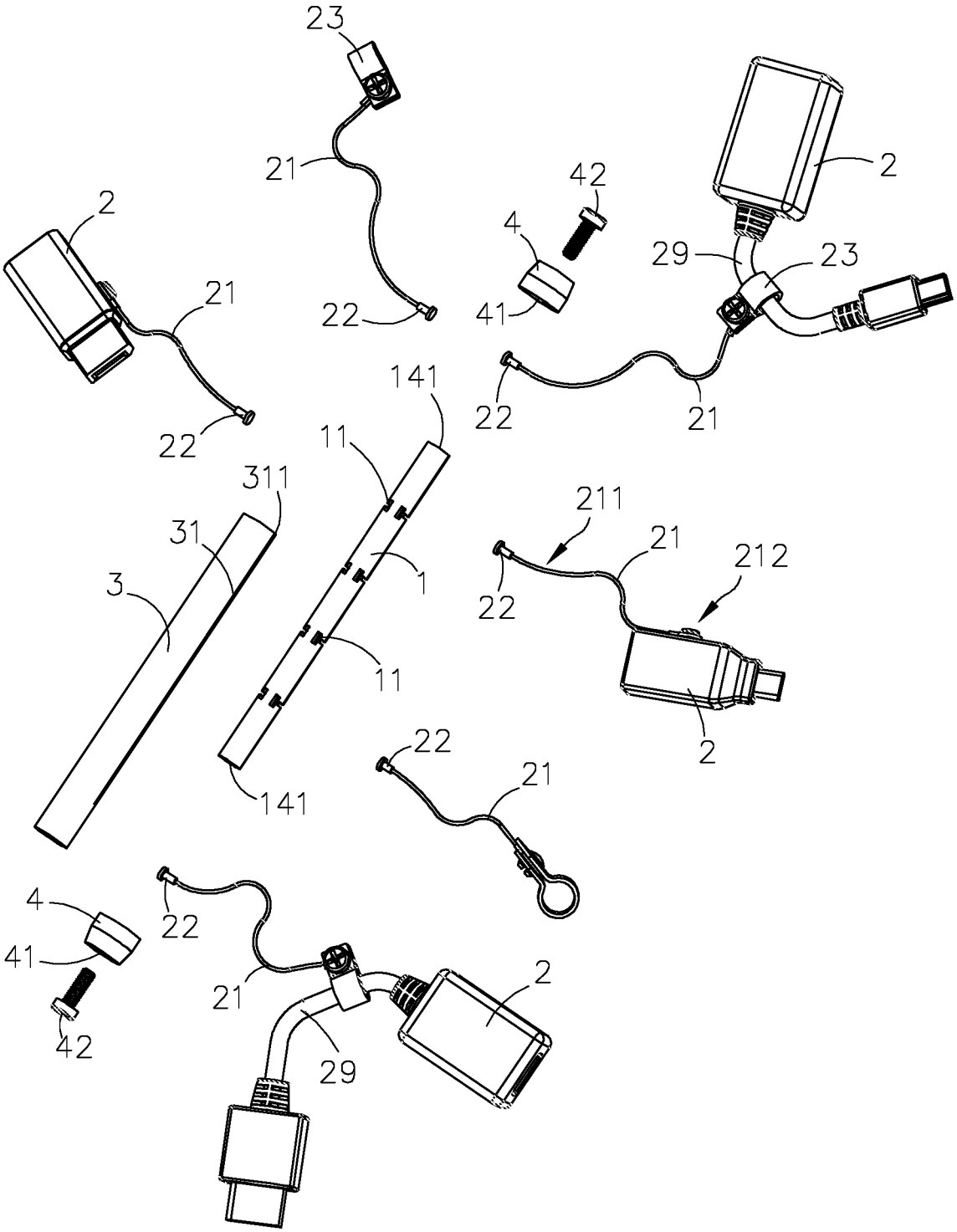
FIG. 1 is an exploded view of the gathering mechanism for adapter according to a first embodiment of the invention.

To clearly illustrate the purpose, structure, and function of the invention, an exemplary embodiment is given below with reference to the accompanying drawings. The invention provides a gathering mechanism for adapter, which includes a cylindrical body 1, a plurality of adapters 2, and an outer sleeve 3.

The cylindrical body 1 is provided with a plurality of accommodating units 11 each of which is indented and spaced apart from each other and mounted on a surface of the cylindrical body 1 in an axial direction of the cylindrical body 1.

The adapters 2 are of a variety of adapter specifications. One end of the adapter 2 is provided with a flexible latching member 21. The other end of the latching member 21 is a free end 211 provided with a bulged joggle unit 22 for being received in the accommodating units 11.

The outer sleeve 3 is configured to sleeve the cylindrical body 1. The outer sleeve 3 is provided with at least one cut groove 31 mounted in an axial direction. The cut groove 31 is configured to be provided with unidirectional openings 311 for allowing the flexible latching member 21 to transversely enter and exit therethrough. The width of the cut groove is smaller than the width of the bulged joggle unit 22, thereby forming a limiting engagement.

Preferably, both ends of the cylindrical body 1 and the outer sleeve 3 are respectively provided with a bulged sealing cap 4. Threaded bores 141 are mounted on both ends of the cylindrical body 1. The two bulged sealing caps 4 may be provided with a perforation 41 on its center for allowing the a screw bolt to pass through and be locked, thereby securing and limiting the outer sleeve 3 to move transversely.

Figure 4:
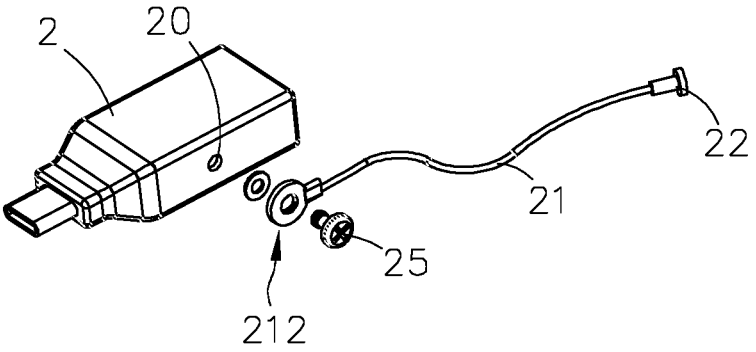
FIG. 4 is a schematic view illustrating the manner of assembling the latching member and the adapter according to the invention.

As shown in FIG. 4, the latching member 21 may be preferably implemented by a steel rope having a fixed end 212 for connecting to the adapter 2. The fixing end 212 may include a wiring terminal for passing through and being locked into a threaded bore 20 of the adapter 2 by a connecting element 25 such as an ordinary screw or a self-tapping screw. The joggle unit 22 may be implemented by a solid block or a wiring terminal.

Figure 5:
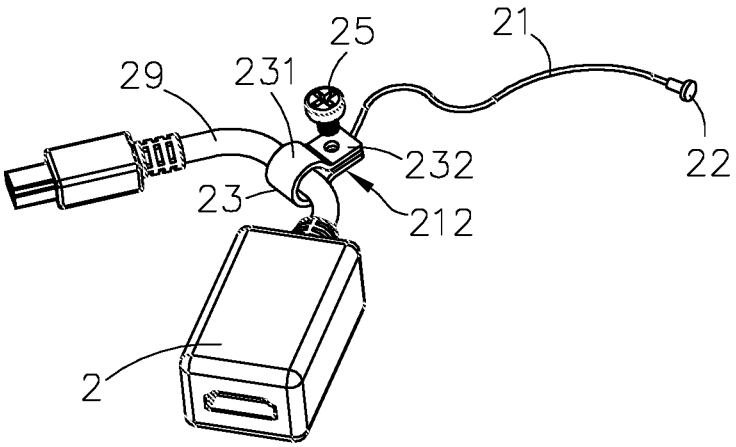
FIG. 5 is an assembled view showing the latching member assembled with an adapter of a wired cable according to the invention.

As shown in FIG. 5, the fixed end 212 of the latching member 21 connecting to the adapter 2 may be preferably replaced with a R-shaped securing clip 23. The R-shaped securing clip 23 includes two bored pieces that are connected to each other through a bended portion 231. The R-shaped securing clip 23 is locked and secured through an ordinary screw or a self-tapping screw, thereby securing the latching member 21 to the adapter 2 of a wired cable 29 by the R-shaped securing clip 23.

Figure 6:
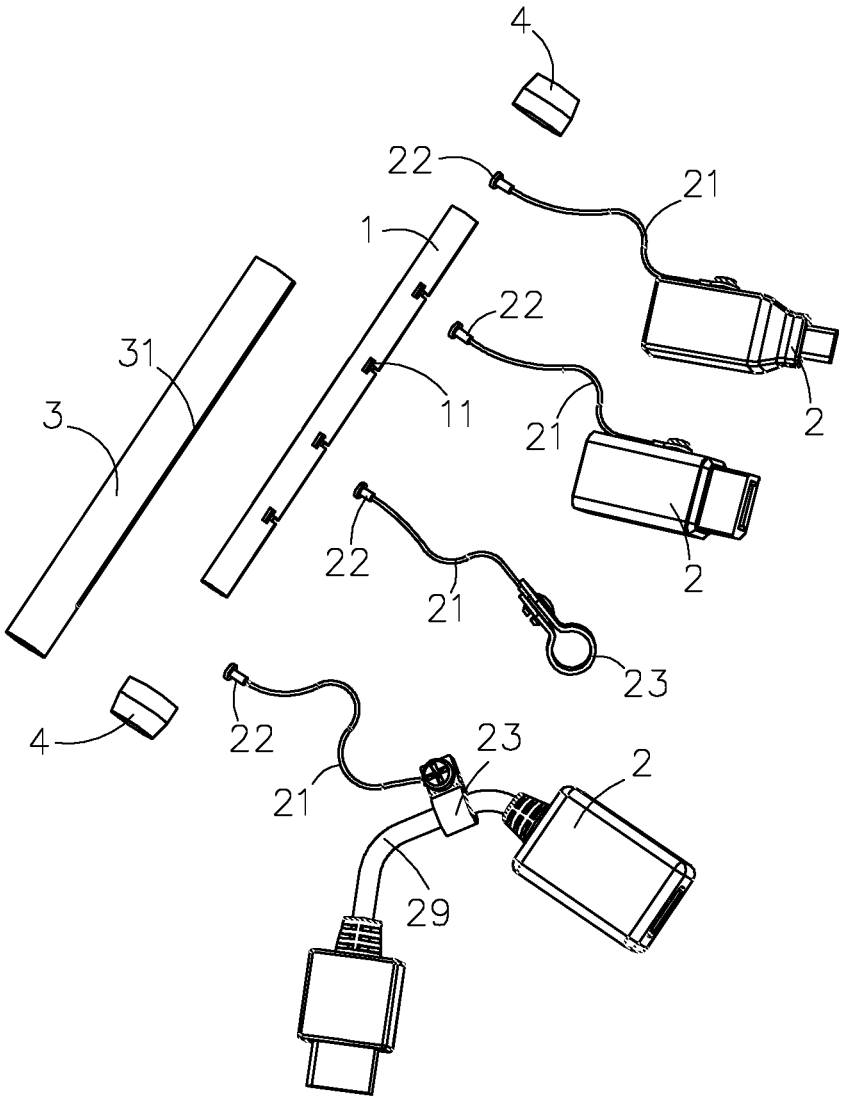
FIG. 6 is an exploded view of the gathering mechanism for adapter according to a second embodiment of the invention.

As shown in FIG. 6, the accommodating units 11 may be preferably mounted on the same side of the cylindrical body 1 in a single line.

Figure 2:
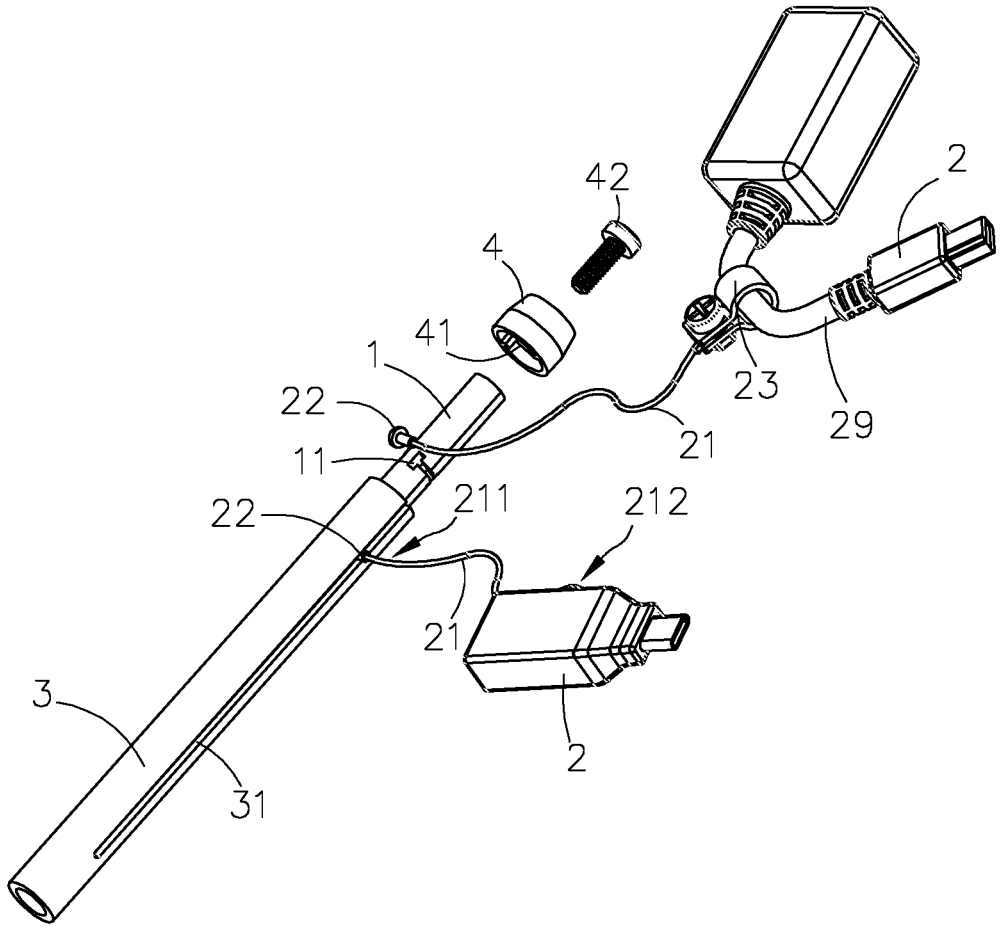
FIG. 2 is an assembled view of the gathering mechanism for adapter according to a first embodiment of the invention.
Figure 3:
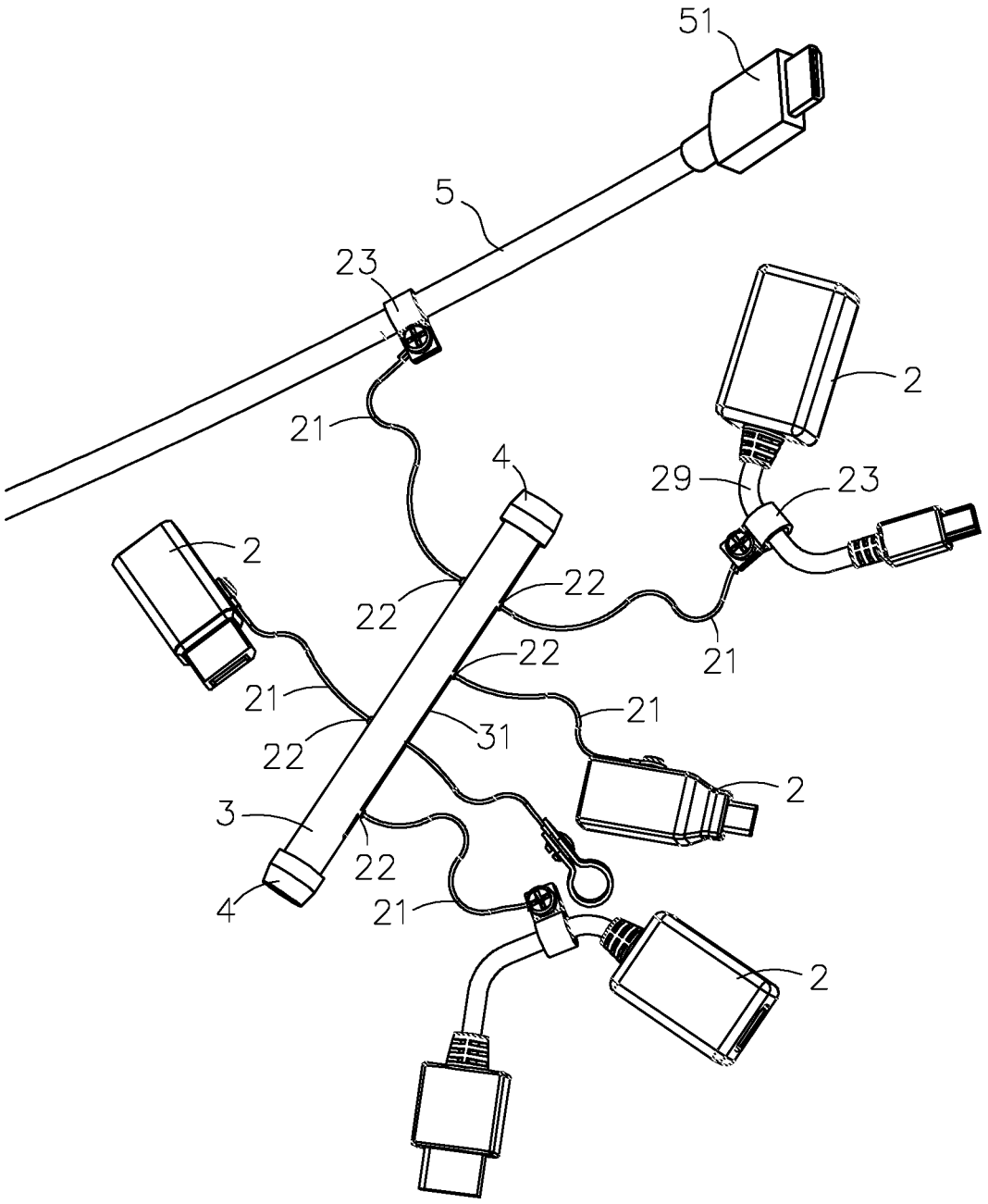
FIG. 3 is a schematic view showing the application of the gathering mechanism for adapter according to a first embodiment of the invention.

As shown in FIGS. 1-3, the accommodating units 11 may be preferably mounted on different sides of the cylindrical body 1 in double lines, and two cut grooves 31 are individually mounted on an opposite side of the outer sleeve 3 in an axial direction. For example, two to four tee accommodating units 11 may be indentedly and spacedly mounted on two opposite sides of the cylindrical body 1 in an axial direction of the cylindrical body 1. The free end 211 of the latching member 21 of the adapter 2 may be provided with a Tee bulged joggle unit 22 for being received in the tee accommodating unit 11, and the unidirectional openings 311 of the two cut grooves 31 mounted on opposite sides of the outer sleeve in an axial direction are aligned so as to allow the corresponding flexible latching member 21 to transversely enter and exit therethrough. Because the width of the cut groove 31 is smaller than the width of the bulged tee joggle unit 22, a limiting engagement is formed thereby. In addition, because both ends of the cylindrical body 1 and the outer sleeve 3 are respectively capped with a bulged sealing cap to secure and limit the outer sleeve 3 from moving transversely, the latching members 21 of the adapters 2 are tidily gathered.

The invention is advantageous in terms of simple structure and practicability. Compared to the prior art, the invention offers the user a brand-new option to gather adapters. With the cylindrical body 1, the latching member 21, and the outer sleeve 3, the invention provides simple and tidy gathering and protection function for multiple adapters 2. By using the invention, the movable range of the adapters is limited by the length of the steel rope of latching member 21 to protect the adapters 2 from being lost or being loosened and taken away by others. Thus, the invention can serve the purpose of preventing adapters 2 from being stolen.

In conclusion, the exemplary embodiment discussed above is merely a preferred embodiment of the invention but is not used to limit the scope of the invention. For an artisan skilled in the art, the invention can encompass various modification and alterations that are made based on the spirit and principle of the invention without departing from the scope of the invention. The scope of the invention should be defined in the appending claims and their equivalents.

The invention claimed is:

1. A gathering mechanism for adapter, comprising:

a cylindrical body having a plurality of accommodating units indentedly and spacedly mounted on a surface of the cylindrical body in an axial direction thereof;

a plurality of adapters, each of which is provided with a flexible latching member on one end thereof, and the other end of the flexible latching member is a free end provided with a bulged joggle unit for being received in a corresponding accommodating unit; and an outer sleeve sleeving the cylindrical body and having at least one cut groove mounted in an axial direction of the outer sleeve for allowing the flexible latching member to transversely enter and exit the therethrough, and wherein a width of the cut groove is smaller than a width of the bulged joggle unit, thereby forming a limiting engagement.

2. The gathering mechanism of claim 1, wherein both ends of the cylindrical body and the outer sleeve are respectively provided with a bulged sealing cap for securing and limiting the outer sleeve from moving transversely.

3. The gathering mechanism of claim 2, wherein the latching member is a steel rope having a fixed end for connecting to the adapter, and wherein the fixed end includes a wiring terminal for passing through and being locking being locked into a threaded bore of the adapter by a connecting element, and wherein the connecting element includes an ordinary screw or a self-tapping screw, and the joggle unit comprises a solid block or a wiring terminal.

4. The gathering mechanism of claim 2, wherein the adapter is an adapter of a wired cable and the latching member is a steel rope having a fixed end, and wherein the fixed end is provided with a R-shaped securing clip including two bored pieces connected to each other through a bended portion, and wherein the R-shaped securing clip is locked and secured through an ordinary screw or a self-tapping screw, thereby securing the latching member to the adapter of the wired cable by the R-shaped securing clip.

5. The gathering mechanism of claim 2, wherein both ends of the cylindrical body are respectively provided with a threaded bore and the bulged sealing caps are respectively provided with a perforation for allowing a screw bolt to pass through and be locked.

6. The gathering mechanism of claim 2, wherein the cut groove is configured to be provided with unidirectional openings.

7. The gathering mechanism of claim 2, wherein the accommodating units are disposed on the same side of the cylindrical body in one line.

8. The gathering mechanism of claim 2, wherein the accommodating units are disposed on different sides in double lines, and two cut grooves are individually mounted on an opposite side of the outer sleeve in an axial direction.

9. The gathering mechanism of claim 1, wherein two to four accommodating units are indentedly and spacedly mounted on two opposite sides of the cylindrical body in an axial direction of the cylindrical body, each of the accommodating units is T-shaped, and wherein the bulged joggle unit is T-shaped for being received in the T-shaped accommodating unit, and wherein two cut grooves are individually mounted on an opposite side of the outer sleeve in an axial direction, and each cut groove is configured to be provided with unidirectional openings for allowing the flexible latching member to enter and exit transversely, and wherein a width of the cut groove is smaller than a width of T-shaped joggle unit to form a limiting engagement, and wherein two sealing caps are mounted on both ends of the cylindrical body and the outer sleeve, and wherein the two sealing caps are bulged to secure and limit the outer sleeve from moving transversely.

* * * * *